US005577300A

United States Patent [19]

Gutrugianios

[11] Patent Number: 5,577,300

[45] Date of Patent: Nov. 26, 1996

[54] STRAP BUCKLE

[76] Inventor: Mike Gutrugianios, 603 Juanita Ave., Millbrae, Calif. 94030

[21] Appl. No.: 377,368

[22] Filed: Jan. 23, 1995

Related U.S. Application Data

[63] Continuation-in-part of Ser. No. 194,257, Feb. 10, 1994, abandoned.

[51] Int. Cl.[6] ..... A44B 11/00

[52] U.S. Cl. ..... 24/170; 24/191

[58] Field of Search ..... 24/170, 191, 193, 24/173, 163 K, 644

[56] References Cited

U.S. PATENT DOCUMENTS

| | | | |
|---|---|---|---|
| 950,434 | 2/1910 | Carlson | 24/170 |
| 1,360,123 | 11/1920 | Lewis | 24/191 |
| 1,394,380 | 10/1921 | Wardner | 24/191 |
| 2,751,656 | 6/1956 | Noe | 24/170 |

*Primary Examiner*—Victor N. Sakran
*Attorney, Agent, or Firm*—Robert J. Schaap

[57] ABSTRACT

A strap buckle permitting slidable movement of a strap, such as a belt, therethrough in a first direction with selective locking by moving the strap in a second direction. The buckle includes a main frame with a roller mounted in the frame and covered by a pivotable cover plate. A common pin journals the roller and pivotally mounts the cover plate to the frame. The roller is rotatably journaled in the frame and is provided with a tooth-containing segment for engaging the belt against the cover plate to lock the strap in a fixed position. The roller comprises an arcuate smooth section, adjacent to toothed section, and which is rotated to lie in juxtaposition to the strap and permit slidable movement of the strap in the slot when the cover member is pivoted to an open position with respect to the frame. A pair of flats are provided on the roller to stop movement of the roller in either direction.

18 Claims, 3 Drawing Sheets

STRAP BUCKLE

RELATED APPLICATION

This is a continuation-in-part application of my U.S. patent application Ser. No. 08/194,257 dated Feb. 10, 1994, now abandoned, entitled "Slide Pinch Buckle."

BACKGROUND OF THE INVENTION

1. Field of the Invention

This invention relates in general to certain and useful improvements in strap buckles and more particularly, in strap buckles, such as belt buckles, which utilize a rotatable locking element for permitting slidable movement of a strap through the buckle and selective locking of the strap when pulled in an opposite direction with respect to the buckle.

2. Brief Description of Related Art

There has been a large number of belt and strap buckles which utilize a slide pinch principle, that is, where a belt is allowed to slide through the buckle and is pinched or locked in a particular position by a locking element. Usually, this locking element is a pivotable or rotatable locking element. While these types of buckles are commonly known, they also present several disadvantages.

In many cases, the strap buckle, such as a belt buckle, is not universally adaptable to receiving belts of varying thicknesses. This is particularly true when the strap is a belt article of wearing apparel such that the strap buckle becomes a belt buckle. In many cases, the belt buckle is designed to receive a belt only of a particular thickness. In other cases, because of the moving and rotatable components, the belt buckle is not particularly reliable and often suffers several failures. Moreover, many of these prior art type belt buckles utilize several moving components and therefore, become expensive to manufacture and assemble.

Representative of these various related art strap and belt buckles is U.S. Pat. No. 1,494,288 dated May 13, 1924 to Rosenblum for Belt Buckle; U.S. Pat. No. 1,360,123 dated Nov. 23, 1920 to Lewis for Belt Buckle; U.S. Pat. No. 3,686,715, dated Aug. 29, 1972 to Brodnicki for Strap System for Material Handling; U.S. Pat. No. 3,605,205 dated Sep. 20, 1971 to Crissy for Low Profile Buckle; U.S. Pat. No. 950,434 dated Feb. 22, 1910 to Carlson for Strap Fastener; U.S. Pat. No. 4,502,188 dated Mar. 5, 1985 to Kohli for Theme Belt Buckle; U.S. Pat. No. 1,482,009 dated Aug. 4, 1992 to Heberling for Belt Buckle; U.S. Pat. No. 1,643,083 dated Sep. 20, 1927 to Otten for Strap Buckle; U.S. Pat. No. 1,394,380 dated Oct. 18, 1921 to Wardner for Buckle; and French Patent no. 1,204,470 to Rignault.

Heretofore, there has not been a low cost, highly efficient strap buckle which is sturdy and eliminates the aforementioned problems associated with those strap buckles of the type mentioned above.

OBJECTS OF THE INVENTION

The present invention provides a unique strap buckle with objectives to overcome those problems associated with related art strap buckles, as well as to achieve other objectives therefor, as hereinafter described.

It is, therefore, one of the primary objects of the present invention to provide a unique strap buckle operating on a slide pinch principle and which permits slidable movement of a strap therethrough in a first direction and with selective locking by moving the strap in a second direction.

It is another object of the present invention to provide strap buckle of the type stated which employs a rotatably offset roller mechanism capable of allowing sliding movement of a strap when opened through the buckle when opened and locking the strap when the buckle is closed.

It is a further object of the present invention to provide a buckle of the type stated which utilizes a roller having a segmented arcuately shaped serrated section capable of engaging a strap and locking the same against a rigid cover member forming part of the buckle and which also includes an arcuately shaped smooth section for allowing the strap to extend therethrough when the cover member is opened with respect to a frame of the buckle.

It is also an object of the present invention to provide a buckle of the type stated which utilizes a rotatable roller having a segmented arcuately shaped serrated section and an arcuately shaped smooth section, as well as a pair of flats for controlling rotatable movement of the roller.

It is an additional object of the present invention to provide a belt buckle of the type stated which can be constructed at a relatively low unit cost, but which is, nevertheless, highly reliable in operation.

With the above and other objects in view, my invention resides in the novel features of form, construction, arrangement and combination of parts and components presently described and pointed out in the claims.

BRIEF SUMMARY OF THE INVENTION

A strap buckle which permits slidable movement of a strap through the buckle when moved in a first direction and with selective locking of the strap in the buckle by moving the strap in a second direction. The buckle of the present invention comprises three major components which include (1) a frame or so-called "base" (2) a hingedly mounted cover plate and (3) a rotatable strap movement controlling roller mechanism, all of which are hereinafter described in more detail.

The term "strap buckle" is used in a broad sense to encompass buckles of the type which are capable of receiving and buckling all types of straps. In particular, the buckle of the invention is highly useful with straps which constitute articles of wearing apparel to be worn about the waist of an individual, but are not so limited. Thus, the term "strap buckle" is used in a broad sense to encompass buckles capable of handling all types of straps and thus, and for this purpose, the term "strap" is also used in a broad sense to include all types of belts, whether identified as straps, belts, or the like.

The frame or base includes an elongate leg with an offset or parallel leg at one end and flanges to receive the roller mechanism between the flanges.

The roller mechanism, as hereinafter described, is journaled to the opposed flanges on the frame by means of a roller shaft or pin. The cover plate is pivotally mounted on the base, or frame, through this shaft and the cover plate with the roller mechanism defines an elongate slot sized to receive a strap in slidable engagement therewith. In other words, the slot is sufficiently large to accommodate the strap in a slidable movement therein. The cover plate is provided with depending side flanges which overly the flanges on the frame and thereby enable the journaling of the cover plate through the roller shaft to the frame. However, since the cover plate is pivotally mounted through the roller shaft, the cover plate is pivotable with respect to the frame and with respect to the roller mechanism, as hereinafter described.

At its opposite end, the frame is provided with a pair of depending ears for pivotally journaling a locking arm which permits retentive engagement of one end of the strap or belt.

The roller mechanism comprises an arcuate serrated or toothed configured surface over a greater portion of the annular surface thereof. this serrated or toothed surface configuration is adapted for engagement with an underside of the belt as it passes through the elongate slot and is, in effect, designed to clamp the belt against the cover plate in order to lock the same in a specific position. The roller mechanism of the present invention also includes as an annular arcuately shaped section which is relatively smooth and which is also located adjacent relationship to the serrated surface section. This arcuately shaped relatively smooth section is adapted to be located in juxtaposition to the strap when the cover plate is pivotally shifted to an opened position with respect to the frame. However, the roller mechanism is rotated to a position where the serrated surface section is located in juxtaposition to the strap when the cover plate is pivoted back to the closed position with respect to the frame.

The roller mechanism of the invention is also eccentrically mounted with respect to the frame and also with respect to the cover plate. This eccentric mounting permits the roller mechanism to be effectively raised and lowered with respect to the strap passing through the buckle. When the cover plate is in the closed position with respect to the frame, the roller is raised so that the serrated surface can tightly engage the belt. However, when the cover plate is pivoted to the opened position, the roller mechanism is effectively lowered with respect to the belt and thereby permits slidable movement of the belt through the buckle.

In summary, when the buckle is opened, there is sufficient room for slidable movement of the strap to position the strap at a desired location. When the buckle is closed, that is, the cover plate is shifted to a closed position, the space for the strap becomes smaller and the strap becomes locked in this space.

The roller mechanism is also provided with a pair of flat surfaces or so-called "flats" which are selectively designed to control the rotatable movement of the roller mechanism in each of the opposite directions. Thus, one flat will engage the frame and stop movement of the roller mechanism when rotating in one direction and a second and adjacent flat will engage the frame and stop movement of the roller mechanism when rotating in the opposite direction.

This invention possesses many other advantages and has other purposes which will be made more fully apparent from a consideration of the forms in which it may be embodied. One of the forms of this apparatus and, for that matter, the associated method, is more fully described in the following description, and more fully illustrated in the accompanying drawings. However, it is to be understood that these drawings and the following detailed description are, set forth for purposes of illustrating and describing the general principles of the invention and are not to be taken in a limiting sense.

BRIEF DESCRIPTION OF THE DRAWINGS

Figure 1:
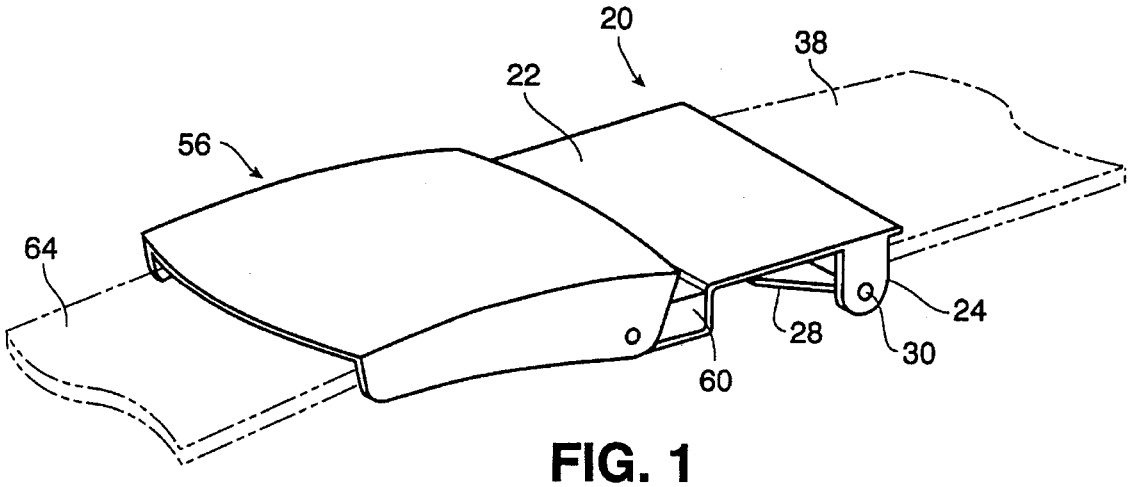
Figure 2:
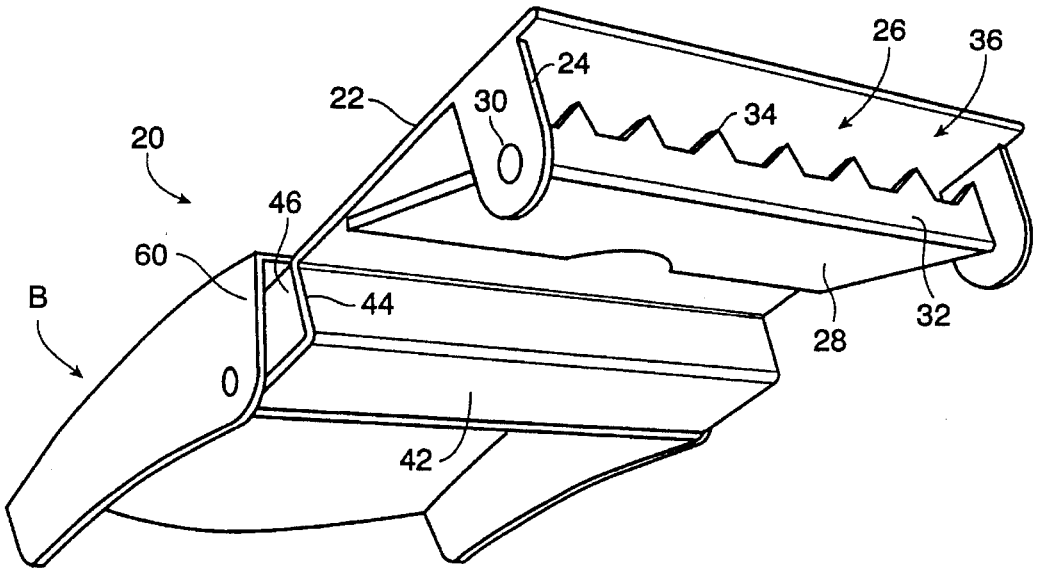
Figure 3:
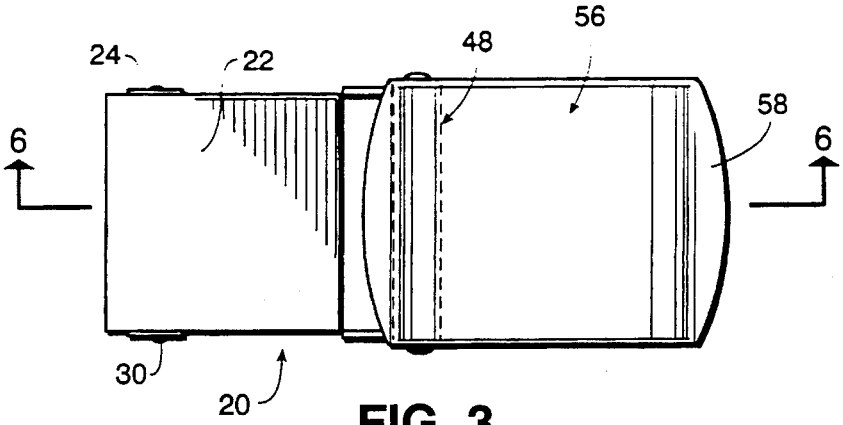
Figure 4:
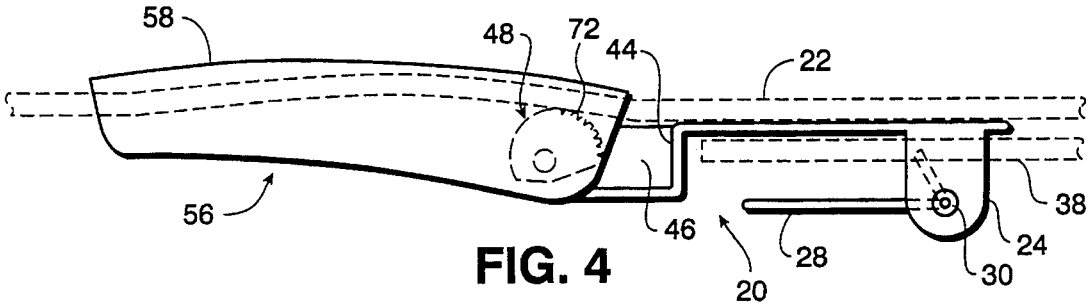
Figure 5:
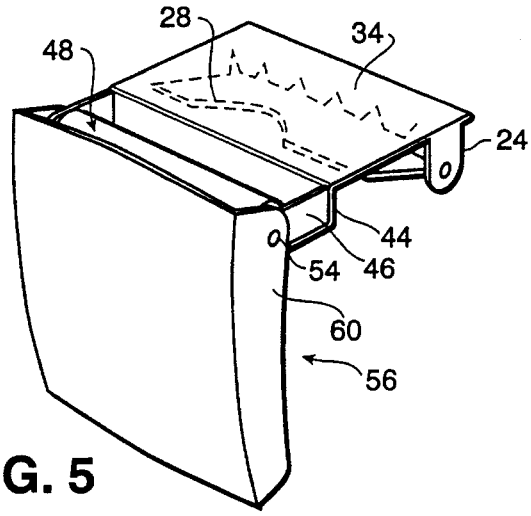
Figure 6:
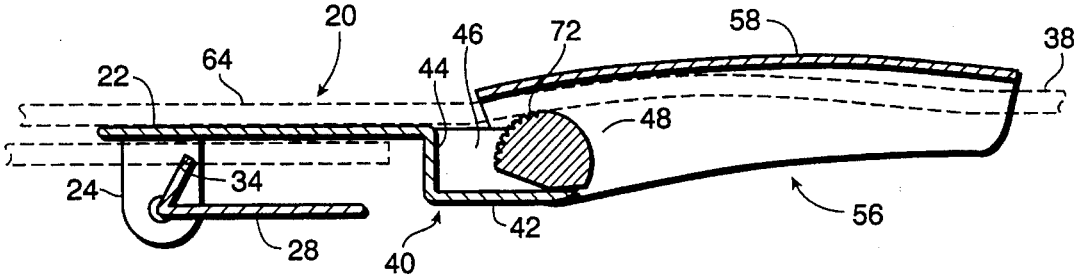
Figure 7:
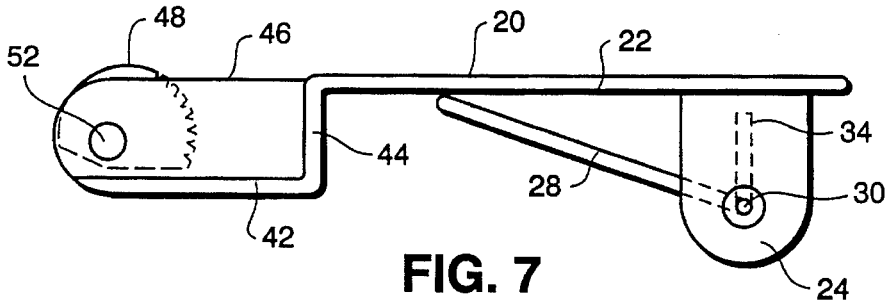
Figure 8:
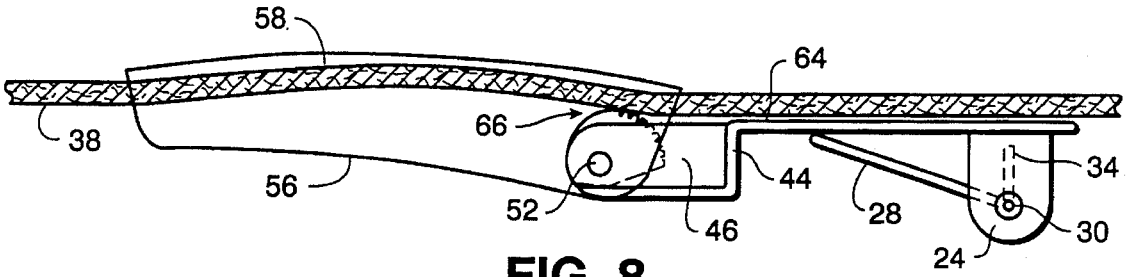
Figure 9:
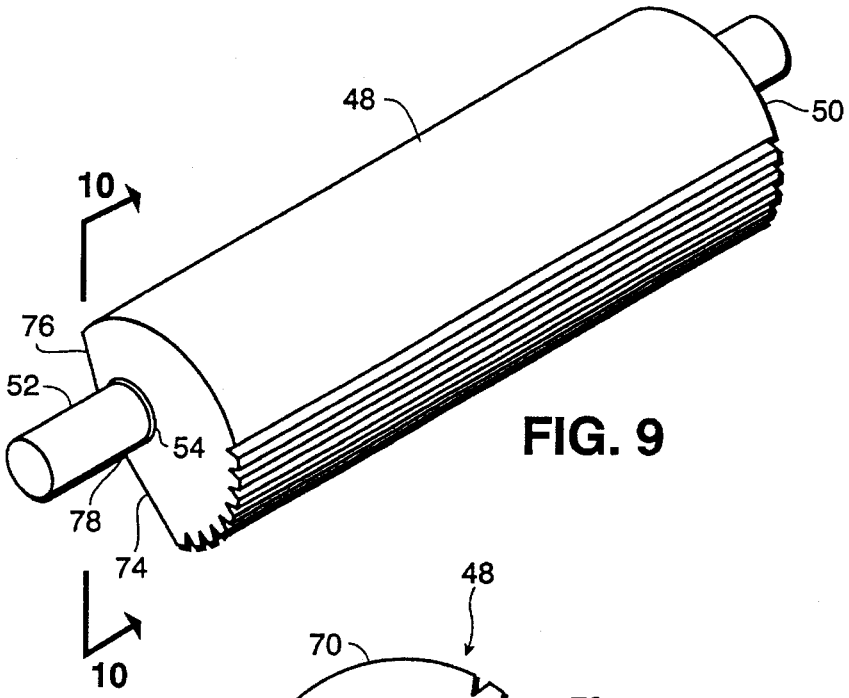
Figure 10:
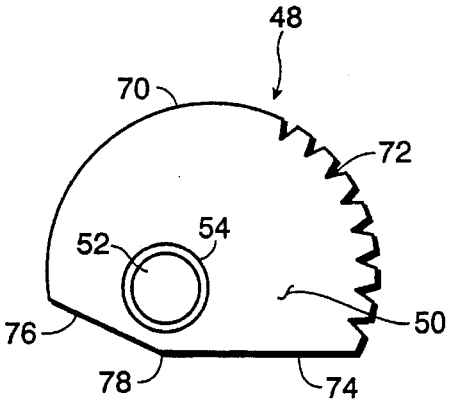

Having thus described the invention, reference will now be made to the accompanying drawings in which:

FIG. 1 is a top perspective view of a buckle constructed in accordance with and embodying the present invention;

FIG. 2 is a bottom perspective view of the buckle of FIG. 1;

FIG. 3 is a top plan view of the strap buckle of the present inventions;

FIG. 4 is a side elevational view of the strap buckle of the present invention;

FIG. 5 is a perspective view showing a cover member of the buckle being bent downwardly in order to expose certain portions of the buckle for purposes of clarity;

FIG. 6 is a vertical sectional view of the buckle substantially taken along the lines 6—6 of FIG. 3;

FIG. 7 is an enlarged sectional view showing the components of the belt buckle with the cover plate removed;

FIG. 8 is an enlarged sectional view, somewhat similar to FIG. 7, and showing the components of the buckle with a strap extending therethrough;

FIG. 9 is a perspective view of the roller mechanism forming part of the buckle of the present invention; and FIG. 10 is an end elevational view of the roller mechanism taken substantially along the plane of line 10—10 of FIG. 9.

DETAILED DESCRIPTION OF PREFERRED EMBODIMENTS

Referring now in more detail and by reference characters to the drawings, B designates a buckle which is constructed in accordance with and embodies the present invention. The buckle B of this invention is primarily useful with belts, such as those belts used as articles of wearing apparel. However, the invention is also applicable to belts of all types, such as industrial belts, including straps and the like. To this extent, the buckle B of the invention is referred to as a "strap buckle", since it is effective with any type of strap. For the purposes of this detailed description, the invention will be described in terms of a belt buckle, although it should be understood that the term "belt" as used herein, will essentially mean any type of strap.

The buckle B comprises a base 20, having a relatively flat plate portion 22 at its rearward end and with a pair of downwardly depending flanges 24, also at its rearward end, as best shown in FIGS., 1, 2, 4 and 5 of the drawings. Rotatably mounted in the flanges 24 is a belt securement assembly 26 comprised of a plate-like member or so-called "flap" 28 which has outwardly projecting lugs adapted for securement within detentes or recesses formed within the flanges 24. In this way, the flap 28 is provided with a pivotable movement. The flap 28 is further provided with an angularly disposed section 32 having a plurality of teeth 34.

It can be observed by reference to FIGS. 2, 4, 5 and 6 of the drawings that when the flap 28 is rotated to a certain position, the teeth 34 are spaced from the upper surface of the plate 22 providing belt-locking slot 36. When a belt end is introduced into the slot 36, the flap 28 is pushed upwardly against the underside of the plate 22 of the base 20, which will cause the teeth 34 to engage the underside of the belt and, in effect, clamp the belt against the underside the plate 22 with the teeth 34 biting into the leather or other material forming part of the belt. In like manner, when it is desired to entirely remove the belt from the buckle B, the flap 28 is pulled downwardly so that the teeth 34 pivot to the left, reference being made to FIG. 2, which will thereby permit release of the end of the belt.

FIGS. 4 and 6 illustrate the use of a belt 38 shown in dotted lines and the securement of the end of the belt 38 within the buckle B. It can be seen that when the flap 28 is shifted to the horizontally disposed position, the teeth 34 secure the end of the belt 38 in a fixed position. In this sense, the securement means assembly 26 is a relatively permanent type of securement assembly or locking assembly and is used only when it is desired remove an existing belt and to use a new belt with the buckle B.

The forward end of the base is provided with a downwardly offset section 40 which has a lower offset plate 42 connected to the upper plate 22 by means of an integral web section 44. In addition, the forward end of the base 22 is provided with side flanges 46, as best shown in FIGS. 2, 5 and 6 of the drawings.

Extending transversely across the base 20 and being journaled in the flanges 46 is a roller assembly 48 comprised of a roller 50 and supported by a pivot pin 52. By reference to FIGS. 9 and 10 of the drawings, it can be seen that the roller 50 is provided with a pin receiving bore extending therethrough for receiving the pivot pin 52. The ends of the pivot pin 52 are journaled in openings 54.

The pivot pin 52 is effective to rotatably mount the roller assembly 48 to the base 20 and also rotatably mounts to the base 20 a cover plate 56, as hereinafter described in more detail. The cover plate 56 is provided with a relatively flat plate section 58, having a pair of integrally formed depending side flanges 60 and which have rearward portions 62 sized to overly forward portions of the flanges 46, as best illustrated in FIGS. 1 and 2 of the drawings. The top surface of the cover plate 56 may be used for carrying a decorative design, advertising or promotional material, or the like. In this way, the belt buckle B can be constructed at a relatively low cost for use as a promotional give-away item. Moreover, it can also be constructed of a more sturdy material and provided with a highly pleasing aesthetic design on the exterior face of the cover 56.

One of the key components of the belt buckle B of the present invention is the roller assembly 48 and its coaction with the base 20. The roller assembly 48 is journaled with respect to the base 20, in the manner as aforesaid, and cooperates with the base 20 to lock and release an opposite end 64 of the belt 38. In this respect, the roller assembly 48 forms with the undersurface of the cover plate 56 a slot 66 to receive the end 64 of the belt 38.

The roller 50 is somewhat semi-cylindrical in shape, as best illustrated in FIGS. 7–10 of the drawings. In this respect, the roller assembly 48 is elongate and is provided on its exterior surface with a somewhat semi-cylindrical, arcuately shaped and relatively smooth annular surface section 70. This surface section 70 integrally merges into an annular serrated surface section 72, having ridges separated by grooves, as best shown in FIGS. 9 and 10 of the drawings. The serrated surface section 72 constitutes about one-half of the curved annular section of the roller 50. Moreover, and with reference to the pivot pin 52 and the pin-receiving bore, the serrated section 72 is located on a right-hand side of the roller 50 and is spaced further away from the pivot pin 52, then is the relatively smooth surface section 70.

The bore of the roller 50 is drilled into and through the roller 50 from the lower left portion thereof, as best shown in FIG. 10, and is eccentrically located with respect to a central axis of the roller 50. The lower portion of the roller 50 is provided with a first relatively flat, transversely extending surface area, or so-called "flat" 74 and which is adjacent to a second transversely extending, relatively flat surface section 76 or so-called "flat" and which is separated from the first flat 74 by an edge 78. These flats 74 and 76 cooperate with the upper surface of the lower plate 42 to limit movement of the roller assembly 48, in a manner as hereinafter described in more detail.

The roller 50 is often referred to as a bar and is, in effect, a locking bar. When the cover 56 is rotated to a vertical orientation, as best shown in FIG. 5, the roller 50 will rotate in a clockwise direction (reference being made to FIGS. 9 and 10), allowing the relatively smooth arcuate section 70 to be spaced from the underside of the cover plate 56. This will, in effect increase the size of the slot 66 thereby allowing the end 64 of the belt 38 to move freely into and outwardly of the slot 66. Thus, the end 64 can be easily and conveniently inserted into the buckle by inserting the same through the slot 66.

It can be observed that as the base or frame 20 is shifted downwardly relative to the cover section 56, the roller 50 will rotate so that the relatively smooth surface section 70 is disposed beneath the belt 38. Consequently, not only does the roller 50 effectively pivot downwardly because of its eccentric mounting on the base 20, but it also allows the relatively smooth section 70 to lie beneath the belt 38, thereby permitting a relatively free withdrawal of the belt 38 from the slot 66.

In actuality, the base section 20 is pivoted downwardly relative to the cover 56. When the base 20 is shifted upwardly, to the position as shown in FIG. 8, the roller 50 will pivot slightly upwardly and the serrated section 72 will be brought into contact with the end 64 of the belt 38 causing the same to be tightly engaged on the underside of the cover plate 56. When there is tension on the belt 38 tending to pull the same to the left (reference being made to FIG. 8), this will cause the roller assembly 48 to pivot even higher and to cause the serrated section 72 to more tightly engage the underside of the belt 64, causing the belt 64 to be retentively locked in its fixed position in the slot 66. However, contrariwise, it can also be observed that when tension is imposed on the end of the belt 64 pulling the same to the right, the roller assembly 48 will pivot slightly downwardly, allowing freer movement of the belt 38. In this way, the belt 38 can be readily and easily tightened, although it cannot be removed without pivoting the base 20 relative to the cover assembly 56 or pivoting the cover assembly 56 relative to the base 20.

By further reference to FIGS. 8–10 of the drawings, it can be seen that rotation of the roller 50 is limited by the flats 74 and 76. In an upward pivoting movement of the roller 50, the flat 74 will stop rotation of the roller 50 as it engages the upper surface of the lower plate 42. In a downward movement of the roller 50, the flat 74 will engage the upper surface of the lower plate 42, limiting the downward movement and hence, the opposite rotation of the roller 50.

The buckle B of the present invention is highly advantageous in that it provides a complete freedom of movement when it is desired to tighten the belt 38 but retentively locks the belt 38 and holds the same in a fixed position when there is any force on the belt 38 tending to remove the same from the buckle B. In effect, only an intentional mechanical action of rotating the base 20 with respect to the cover assembly will cause a release of the belt 38. Moreover, the buckle B of the invention will lock the belt 38 in precisely that position desired by the user. It does not require an over pulling with a slight opposite direction movement to achieve a desired position, as in many of the prior art buckles. Moreover, the rotation of the roller assembly 48 is effectively limited so that the serrated section 72 is always in contact with the belt 38 when there is no intentional release of the belt 38 from the buckle B.

As indicated previously, the term "strap" is used in a broad sense to encompass belts of any type and the like. The present invention has been described in detail in terms of one embodiment in which the buckle B is used as a belt buckle. To that extent, the strap has been described as a belt. However, and as indicated above, the buckle B could be used as a strap buckle in industrial equipment and the like.

Thus, there has been illustrated and described a unique and novel buckle which is fully adjustable and easy and convenient to operate and which thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described my invention, what I desire to claim and secure by letters patent is:

1. A strap buckle permitting slidable movement of a strap therethrough in a first direction with selective locking by moving the strap in a second direction, said strap buckle comprising:

a) a frame;

b) a cover member associated with said frame and together with said frame forming a slot for receipt of said strap and permitting slidable movement of said strap through said slot; and c) roller means operatively associated with said frame and having an arcuately shaped surface section with an irregular surface for engagement with said strap to lock said strap with respect to the frame and the cover member, said roller means being rotatable and having a a first flat surface section and which roller means can be rotated in one direction to allow slidable movement of the strap through the slot and where said first flat surface section engages said frame to stop movement in that one direction and a second flat surface section which engages the frame and stops movement of the roller means in the opposite direction.

2. The buckle of claim 1 further characterized in that said strap is a belt article of wearing apparel and said buckle is a belt buckle.

3. The buckle of claim 1 further characterized in that said roller means is rotatably journaled on said frame.

4. The buckle of claim 1 further characterized in that a shaft is journaled on said frame and carries said roller means and said roller means is eccentrically mounted with respect to said shaft so that the arcuately shaped surface section is closer to the strap in the locking position and is shifted away from the slot when the roller means is rotated.

5. The buckle of claim 1 further characterized in that said arcuately shaped surface section is comprised of alternating ridges and recesses.

6. The buckle of claim 1 further characterized in that said cover member is hingedly mounted with respect to said frame.

7. The buckle of claim 1 further characterized in that said first flat surface section is adjacent to said second flat surface section and connected to said second flat surface section by a ridged edge extending therebetween.

8. The buckle of claim 1 further characterized in that said roller means is eccentrically mounted so that upon rotation in one direction the irregular surface is moved closer to the strap and engages the strap, and when the roller means is rotated in the opposite direction the irregular surface is moved further away from the strap allowing movement through the slot.

9. The buckle of claim 8 further characterized in that said roller means also has a relatively smooth arcuate section adjacent the irregular surface and which is rotated to a portion where it lies in juxtaposition to the strap allowing for withdrawal of the strap from the buckle.

10. The buckle of claim 9 further characterized in that said cover member is hingedly pivoted to said frame and said relatively smooth surface moves into juxtaposition to said strap when said frame and cover member are pivoted relative to one another.

11. A strap buckle permitting slidable movement of a strap therethrough in a first direction with selective locking of the strap by moving the strap in a second direction, said strap buckle comprising:

a) a frame;

b) a cover member associated with said frame and together with said frame forming a slot for receipt of said strap and permitting slidable movement of said strap through said slot;

c) pivot means for pivotally mounting such cover member to said frame; and d) roller means operatively associated with said frame and having an arcuately shaped surface section with an irregular surface for engagement with said strap to lock said strap with respect to the frame and the cover member, said roller means being rotatable and having a first flat surface section which is relatively smooth and which can be rotated to lie in juxtaposition to the strap and engages said frame to limit rotatable movement in the first direction and a second flat surface section to engage said frame and limit rotatable movement in a second direction and which permits slidable movement of the strap through the slot when the frame and cover member are pivoted to an open position relative to one another.

12. The buckle of claim 11 further characterized in that said roller means is rotatably journaled on said frame by said pivot means.

13. The buckle of claim 11 further characterized in that said pivot means comprises a pin which is journaled on said frame and carries said roller means and said roller means is eccentrically mounted with respect to said pin so that the arcuately shaped surface section is closer to the strap in the locking position and is shifted away from the slot when the roller means is rotated.

14. In a strap receiving buckle which receives and locks a portion of the strap in a selected position and which is comprised of a frame and cover member hingedly mounted to said frame and having a slot for slidable movement of the strap therethrough, an improvement comprising:

a) a roller means operatively rotatable on said frame and having an arcuately shaped surface section with an irregular surface for engagement with said strap to lock said strap with respect to the frame and the cover member, said roller means having a second arcuate surface section which is relatively smooth and which can be rotated to lie in juxtaposition to the strap and which thereby permits slidable movement of the strap through the slot when said frame and cover member are pivoted relative to one another, said roller means also having a first flat surface section which engages said frame to limit rotatable movement in a first direction and a second flat surface section to engage said frame and limit rotatable movement in a second direction.

15. The buckle of claim 14 further characterized in that said roller means is eccentrically mounted with respect to a pin journaling same so that the irregular surface is closer to the strap in a strap locking position and is shifted away from the strap when the roller means is rotated.

16. The buckle of claim 15 further characterized in that said first flat surface section is adjacent to said second flat surface section and connected to said second flat surface section by a ridged edge extending therebetween.

17. The buckle of claim 15 further characterized in that said roller means is eccentrically mounted so that upon rotation in one direction the irregular surface is moved closer to the strap and when rotated in the opposite direction the irregular surface is moved further away from the strap allowing movement through the slot.

18. The buckle of claim 15 further characterized in that said irregular surface is comprised of alternating ridges and recesses.

* * * * *